US005533279A

United States Patent [19]

Mitsui et al.

[11] Patent Number: 5,533,279

[45] Date of Patent: Jul. 9, 1996

[54] SHOE HAVING A SKELTON-SHAPED OUTER CARAPACE

[75] Inventors: Shigeyuki Mitsui, Niigata; Yoshiaki Hase, Kobe, both of Japan

[73] Assignee: Asics Corporation, Japan

[21] Appl. No.: 465,743

[22] Filed: Jun. 6, 1995

Related U.S. Application Data

[63] Continuation of Ser. No. 184,112, Jan. 21, 1994, abandoned.

[30] Foreign Application Priority Data

Jan. 29, 1993 [JP] Japan ..... 5-013881

[51] Int. Cl.[6] ..... A43B 23/00; A43C 11/00

[52] U.S. Cl. ..... 36/50.1; 36/45.00; 36/88.0; 36/55.00

[58] Field of Search ..... 36/114, 50.1, 45, 36/10, 105, 88, 89, 55

[56] References Cited

U.S. PATENT DOCUMENTS

| | | | |
|---|---|---|---|
| D. 341,927 | 12/1993 | Worthington . | |
| D. 342,604 | 12/1993 | Avar . | |
| 1,803,554 | 5/1931 | Knilans | 36/114 |
| 1,983,408 | 12/1934 | Shea | 36/55 |
| 2,147,197 | 2/1939 | Glidden | 36/45 |
| 3,130,566 | 4/1964 | Chesebro | 36/10 |
| 3,289,328 | 12/1966 | Abel | 36/10 |
| 4,222,183 | 9/1980 | Haddox | 36/114 |
| 4,282,657 | 8/1981 | Antonious | 36/114 |
| 4,577,419 | 3/1986 | Chassaing | 36/114 |
| 4,809,447 | 3/1989 | Pacanowsky et al. | 36/10 X |
| 4,856,209 | 8/1989 | Kenyon | 36/114 |
| 4,972,609 | 11/1990 | Oh et al. . | |
| 4,972,613 | 11/1990 | Loveder | 36/114 |
| 5,243,772 | 9/1993 | Francis et al. | 36/114 |
| 5,319,869 | 6/1994 | McDonald et al. | 36/114 |

FOREIGN PATENT DOCUMENTS

| | | |
|---|---|---|
| 4445 | 11/1924 | Japan . |
| 42-19821 | 11/1967 | Japan . |

*Primary Examiner*—Paul T. Sewell
*Assistant Examiner*—Marie Denise Patterson
*Attorney, Agent, or Firm*—Nixon & Vanderhye

[57] ABSTRACT

A shoe including a sole, toe reinforcement portion, heel reinforcement portion, eyelet portion, skeleton-shaped reinforcement portion, an adjustable tightening member for adjusting the ankle to heel portion of the shoe, a lace engaging the eyelet portion for adjusting the fit from toe to instep portion, and a sock inner as an internal carapace portion for covering, accommodating and holding the foot of the wearer. The toe reinforcement portion, heel reinforcement portion, eyelet portion, and skeleton-shaped reinforcement portion define an outer carapace portion. Improved fit with the foot and ankle and air intake and exhaust within the shoe accelerated to improve the aerating action.

19 Claims, 12 Drawing Sheets

SHOE HAVING A SKELTON-SHAPED OUTER CARAPACE

This is a continuation of application Ser. No. 08/184,112, filed Jan. 21, 1994, now abandoned.

BACKGROUND OF THE INVENTION

1. Field of the Invention

The present invention relates to a shoe having a skeleton-shaped outer carapace provided with an inner carapace portion for accommodating a foot.

2. Description of the Related Art

In general, a conventional shoe has a sole portion and a carapace portion connected to the sole portion for covering an instep of the foot.

The carapace portion of the shoe is intended to cover the instep and a heel of the foot, except an underneath surface thereof, and must hold the foot as well as protect the foot from outer shock during use of the shoe.

Further, shoes, in particular athletic shoes, are required to fit the feet for enhancing athletic function.

A conventional athletic shoe was provided in the carapace portion thereof with a plurality of pieces such as an upper, bellows and the like, and reinforcements were sewn onto the carapace portion provided with such pieces. In order to function as a shoe, proper and fixing properties in addition to fitting properties are indispensable. However, even if the carapace portion was made of a stretch material to develop the fitting property, the carapace portion was required to be reinforced by a seam or other various reinforcements, which inhibited the fitting property.

A piece called an inner which desirably has heat insulation, waterproof, and shock relaxation properties has been used. For the inner, a material having almost no stretch property has been used. Even when the inner had a stretch property, it was only for the one portion contacting the instep and the ankle of the foot. Further, there were a number of stitches in the inner, which detracted from appropriate fit comfortable feel when wearing the shoes, and it has been technically difficult to reduce these stitches.

SUMMARY OF THE INVENTION

It is therefore an object of the present invention to provide a shoe having a skeleton-shaped outer carapace which develops a fitting property with a foot and an ankle, improves an aeration function within the shoe, and provides a well-fitting and comfortable feel when wearing the shoe.

The object of the invention can be achieved by a device including a sole, a hard and skeleton-shaped outer carapace fixed onto the sole, and a soft inner carapace portion directly contacting the foot, the soft inner carapace accommodated separately in the outer carapace portion, and is fixed on the sole in at least one portion of a lower edge thereof.

According to the shoe having the skeleton-shaped outer carapace of the present invention, the outer carapace portion fixed onto the sole is shaped as a skeleton, and includes the toe reinforcement portion, the heel reinforcement portion, the eyelet portion, and at least one longitudinal reinforcement portion for connecting the sole with the eyelet portion, and of the lateral reinforcement portion for connecting the sole with the heel reinforcement portion. The inner carapace portion contacts directly with the foot, is accommodated in the outer carapace portion but separately from the outer carapace portion, and fixed on the sole in at least one portion of the lower edge thereof. The outer carapace portion is hard, and the inner carapace portion is soft.

Therefore, a major part of the inner carapace portion can move separately from the outer carapace portion in a space within the outer carapace portion, hence, the inner carapace portion is allowed to deform, stretch and contract independently from the outer carapace portion. Thus, the present invention provides a proper fit with the foot and the ankle, and can accelerate air intake and exhaust within the shoe to improve aeration action. Further, since there is no seam portion for connecting the inner carapace portion with the outer carapace portion, the well-fitting and comfortable feel in wearing the shoe can be improved.

According to a preferred characteristic of the shoe having the skeleton-shaped outer carapace of the present invention, it is preferable that the inner carapace portion is formed unitedly by using a material cut out tri-dimentionally. Thus, the fitting property of the inner carapace portion with the foot and the ankle can be further enhanced.

According to the shoe of the present invention, the well-fitting property with the foot and the ankle can be improved, and the air intake and exhaust within the shoe can be accelerated to improve the aerating action, and further the well-fitting and comfortable feel when wearing the shoe can be enhanced.

Further objects and advantages of the present invention will be apparent from the following description of the preferred embodiments of the invention as illustrated in the accompanying drawings.

DESCRIPTION OF THE PREFERRED EMBODIMENTS

The preferred embodiments of the present invention will be described with referring to the figures.

Figure 1:
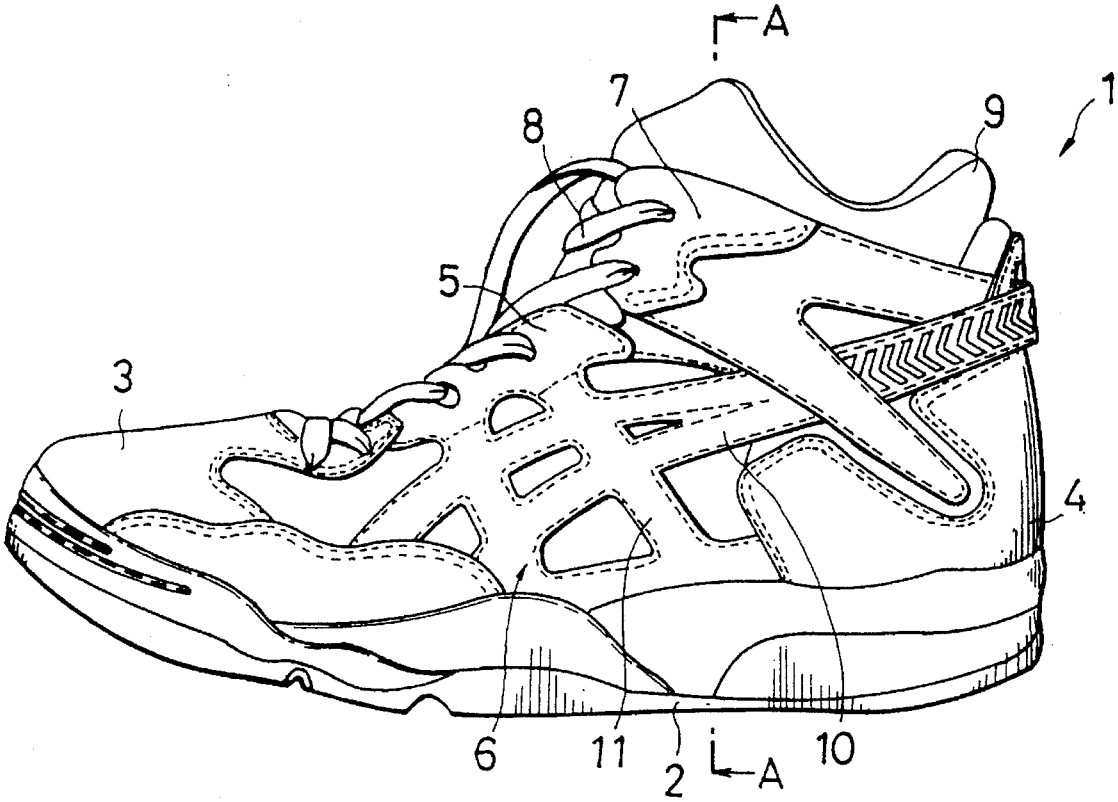
FIG. 1 is a side view of an entire shoe showing a skeleton-shaped outer carapace according to the present invention.

As shown in FIG. 1, a shoe 1 of the present invention includes a sole 2, a toe reinforcement portion 3, a heel reinforcement portion 4, an eyelet portion 5, a skeleton-shaped reinforcement portion 6, a tightening member 7 for adjusting a fitting from an ankle to the heel portion of a wearer of the shoe, a lace 8 engaging the eyelet portion 5 for adjusting the shoe fit from the toe to an instep portion of a wearer of the shoe, and a sock inner 9 as the internal carapace portion for accommodating and holding the foot of the wearer by covering it, the toe reinforcement portion 3, the heel reinforcement portion 4, the eyelet portion 5, and the skeleton-shaped reinforcement portion 6 constituting an outer carapace portion.

The toe reinforcement portion 3 and the heel reinforcement portion 4 are fixed onto the front and back of the sole 2, respectively. The eyelet portion 5 is connected to the sole 2 through the toe reinforcement portion.

The skeleton-shaped reinforcement portion 6 has a skeleton construction composed of a lateral strip member 10 for connecting the toe reinforcement portion 3 with the heel reinforcement portion 4, and a longitudinal strip member 11 for connecting the sole portion 2 with the eyelet portion 5. Note that the lateral strip 10 extends intermediate the region between the eyelet portion 5 and the sole 2. The lateral strip member 10 and the longitudinal strip member 11 are disposed on the inner and outer sides of the shoe, and associate with each other to define a plurality of holes. This skeleton-shaped reinforcement portion 6 is completely separated from the sock inner g, and is dimensioned well enough to connect the sole 2, the toe reinforcement portion 3, the heel reinforcement portion 4 and the eyelet portion 5 with each other to reinforce the shoe. In the preferred form illustrated in FIG. 1, it will be seen that there are two lateral strip members 10 substantially parallel to one another and two longitudinal strip members 11 substantially parallel to one another, the pairs of lateral and longitudinal strip members crossing each other to form cross-points in a center of the side portion of the shoe between its opposite ends and generally centrally between eyelet portion 5 and sole 2. Further, the crossing strips define holes in the carapace skeleton as clearly seen in FIG. 3.

Figure 2:
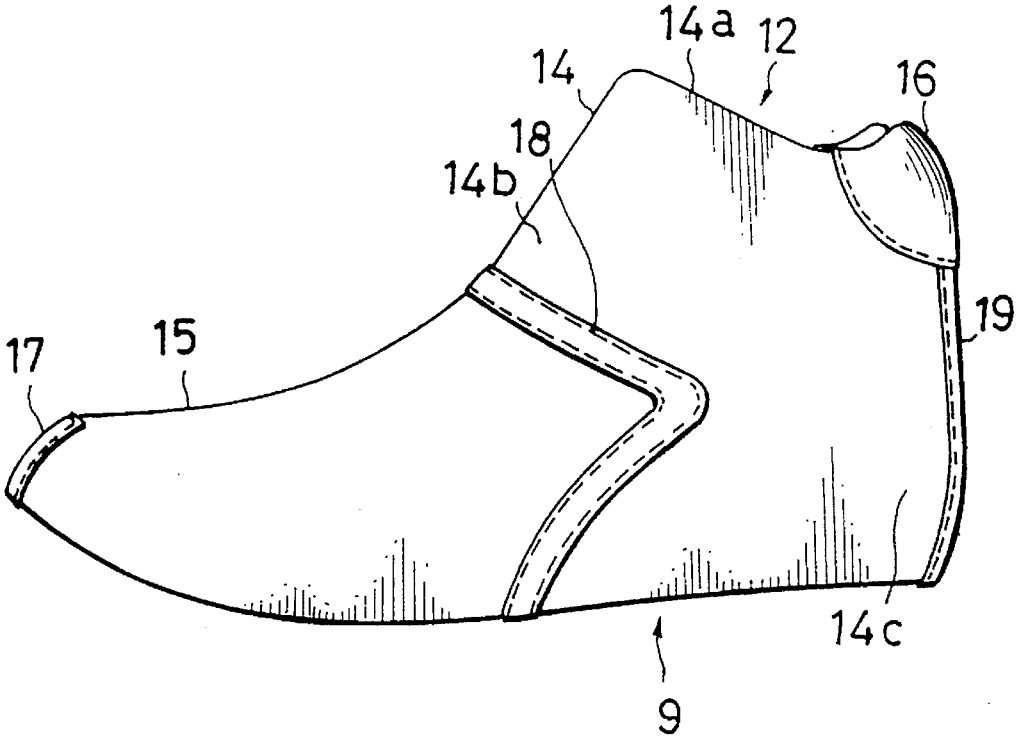
FIG. 2 is a side view of a sock inner according to the present invention.

FIG. 2 is a unit assembly of the sock inner 9. The sock inner 9 has a form similar to the foot of the wearer to fit it, and is provided with an opening 12 in an upper portion thereof for allowing the foot to be inserted there through.

Figure 3:
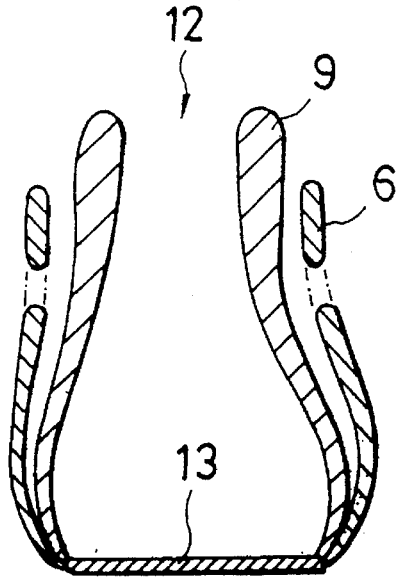
FIG. 3 is a cross-sectional view in line A—A of the shoe having the skeleton-shaped outer carapace of FIG. 1.

As shown in FIG. 3, the sock inner 9 is fixed onto an insole 13 only at a lower edge thereof, and is not sewn together with the outer carapace portion. The upper portion, front and back portions, and side portions of the sock inner 9 are constructed in a free state.

The sock inner 9 is composed of an upper inner 14 for accommodating an arch, the heel and the ankle, a lower inner 15 for accommodating the toe and the arch, a lining 16 for reinforcing a rear portion of an upper peripheral edge portion 14*a* defining the opening 12, a toe protection tape 17, a joint tape 18 for joining the upper inner 14 to the lower inner 15, and a heel protection tape 19.

Figure 4:
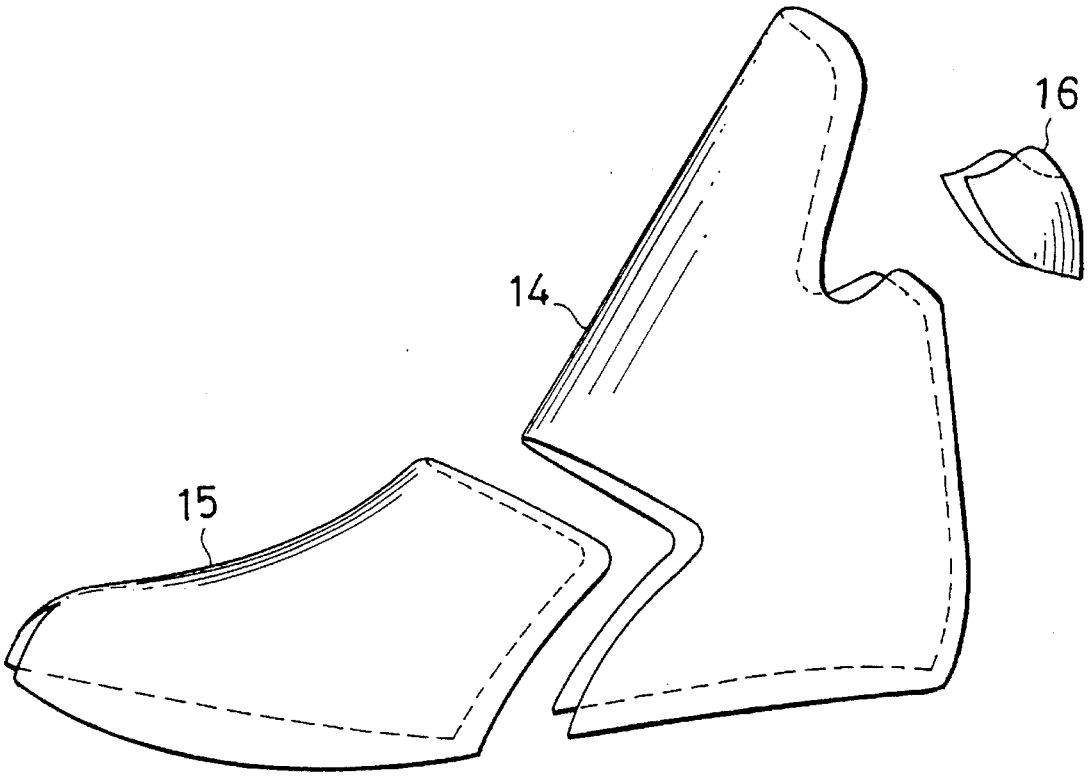
FIG. 4 is a cutting view of the sock inner of FIG. 2.

As shown in FIG. 4, the upper inner 14, the lower inner 15, and the lining 16 have support and stretch properties, and they are cut out tri-dimensionally using a material softer than that of the outer carapace portion like the skeleton-shaped reinforcement portion 6. The upper inner 14 and the lower inner 15 are separated in a transition portion from the ankle to the instep. Such separation face is formed in a zigzag so as to maintain the stretch property of the sock inner 9 after sewing.

Figure 5:
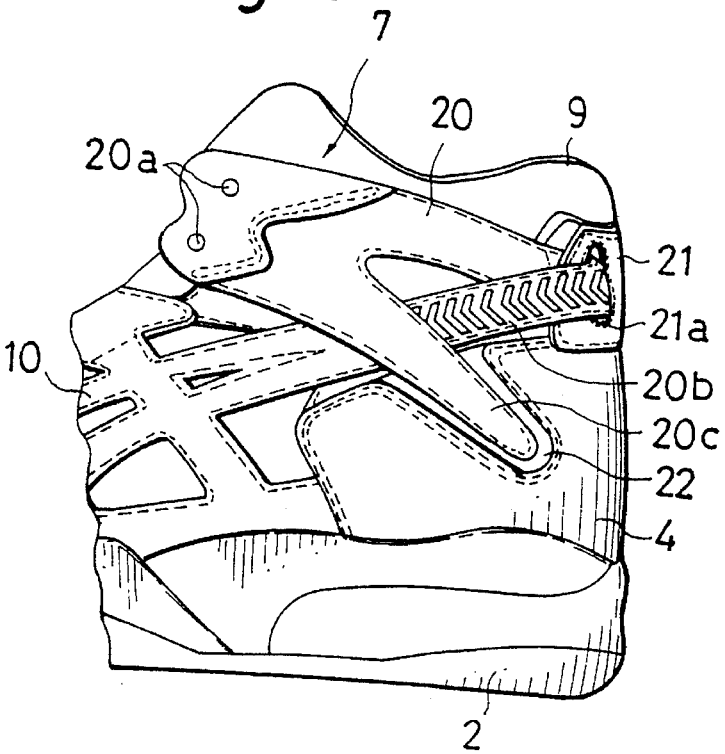
FIG. 5 is a side view of a tightening member according to the present invention.
Figure 6:
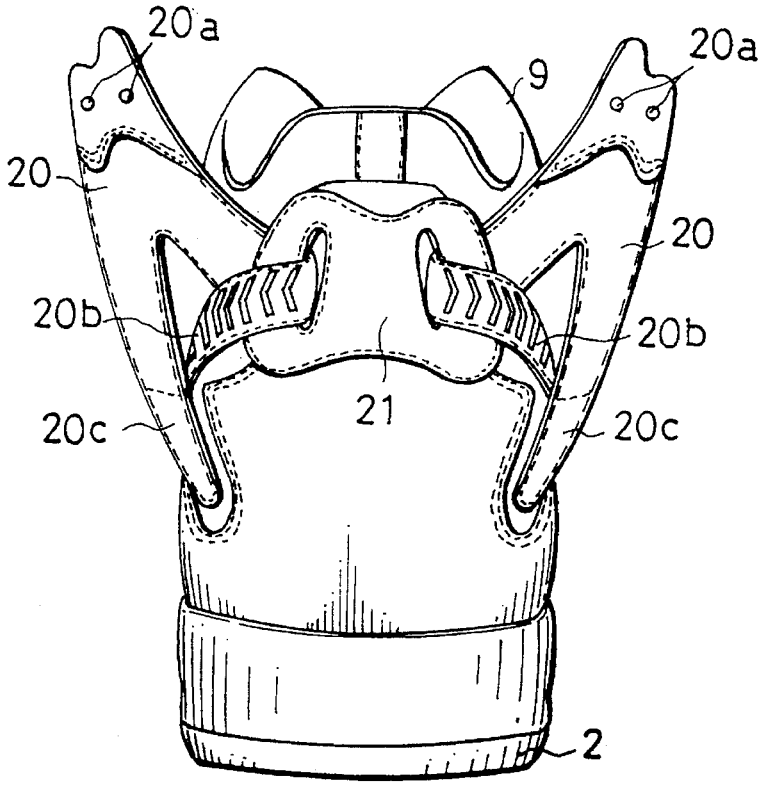
FIG. 6 is a rear view of the tightening member of FIG. 5.
Figure 8:
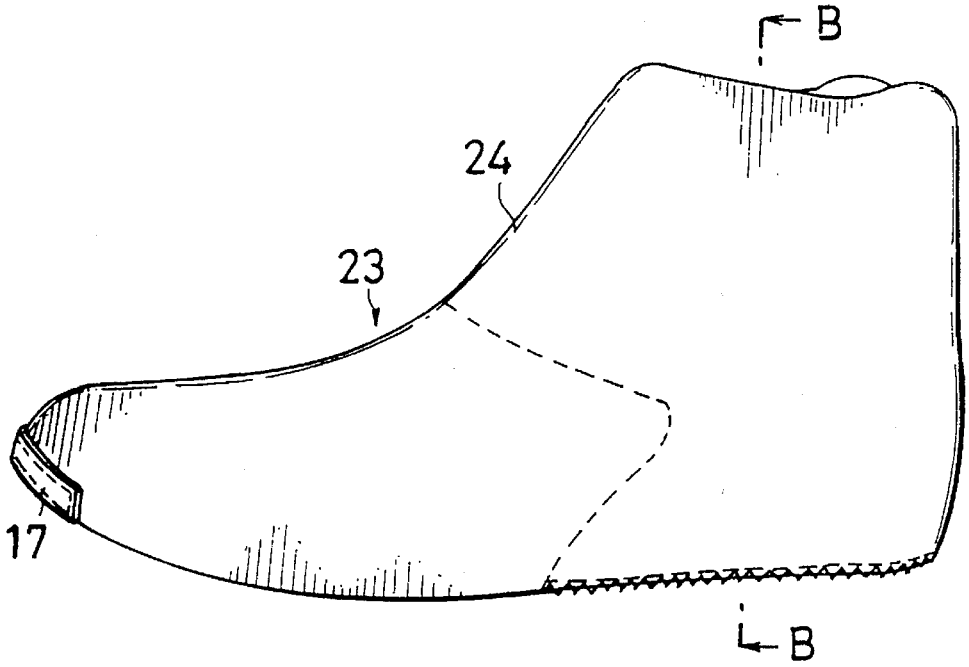
FIG. 8 is a view of another variation of the sock inner according to the present invention.

As shown in FIGS. 5 & 8, the tightening member 7 includes two straps 20 disposed on the inner and the outer sides of the shoe 1, two holes 21*a*, and an adjuster 21 disposed on the heel reinforcement portion 4. The strap 20 is provided at an end thereof with holes 20*a* for allowing the lace 8 to pass therethrough, and the strap 20 is divided into two branches at the other end. One 20*b* of the two branches passes through the adjuster 21, and is integrally connected to one end of the lateral strip member 10 of the skeleton-shaped reinforcement portion 6. The other one 20*c* of the branches is fixed onto a stretch member 22 located on the heel reinforcement portion 4. A tightening direction of the strap 20 can be changed through the intermediary of the stretch member 22 when putting on the shoe.

Usage and functions of the shoe 1 of the embodiments explained with referring to FIGS. 1 to 6, will be described hereinafter.

When putting on the shoe 1, the foot is inserted through the opening 12 of the sock inner 9 from the toe, and is accommodated in the sock inner 9 up to the ankle. After that, when the shoe fits appropriately the foot by adjusting the tightening member with the lace 8, the lace 8 is tied. At that time, the toe and the instep are fixed by the eyelet portion 5, and the ankle and the heel portion are fixed by the tightening member 7.

The sock inner 9 is unitedly formed, matching the shape of the foot. The material having support and stretch properties is almost always used. The sock inner 9 is cut out tri-dimensionally so as not to damage the stretch property. Therefore, the sock inner 0 can support firmly the foot and the ankle can follow up the movement of the foot. Further, there is an appropriate clearance between the sock inner 9 and the foot, so it attenuates stiffness which is liable to be produced in a sock construction.

Further, the sock inner 9 is fixed on the insole 13 at the lower edge thereof and is separated from the outer carapace portion, hence the degree of freedom is large. Deformation, stretch, and contraction are freely realized in accordance with the movement of the foot. Therefore, the fit with the foot and the ankle is improved, and efficiency with the lace and the tightening member is also developed.

Since the sock inner 9 is not sewn together with the outer carapace portion, only a few stitches are required, hence, a well-fitting, comfortable feel when wearing the shoe is developed, and even after the long usage, the sock inner 9 does not fray and a cloth material of the sock inner 9 is not torn.

The material of the sock inner 9 preferably has flexibility for fitting the foot by following the movements of the foot, as well as air permeability and a heat retaining property for obtaining comfortableness. The material for reducing the sensible temperature may be also used. The material can be selected from various hard and soft materials, for example, it is selected such that the material of the inside of the opening 12 directly contacting the ankle is softer than that of the outside so as to permit the ankle to feel better.

The fitting property can be further improved by increasing the height of the upper peripheral edge portion 14*a* of the sock inner 9. Therefore, the height of the upper peripheral edge portion 14*a* of the sock inner 9 is determined in accordance with the intended use, such as marathon, basket ball or the like, whereby a most suitable shoe can be obtained.

Since the sock inner 9 has in itself certain functions naturally possessed by the shoe, the outer carapace is simplified.

The skeleton-shaped reinforcement portion 6 has a skeleton construction made only by a lateral strip member 10 and a longitudinal strip member 11 which are dimensioned well enough to connect the sole 2, the toe reinforcement portion 3, the heel reinforcement portion 4, and the eyelet portion 5 with each other and reinforce the shoe. Therefore, a plurality of openings are formed in the reinforcement portion 6 to thereby improve air permeability and lighten the shoe. The skeleton-shaped reinforcement portion 6 is separated from the sock inner 9 and is not fixed thereto, and therefore the portion 6 does not restrain the movement of the sock inner 9.

The strap 20 and the adjuster 21 forming the tightening member 7 are arranged in the heel reinforcement portion 4. When the tightening member 7 is fastened with the lace 8, both the ankle and the heel portion can be fixed, and fitting and fixing properties are improved. So, in particular, the athletic function for various types of athletic race shoes can be accommodated. Further, several functions are fulfilled by one member, therefore, the construction of the shoe can be simplified.

A variation of the present invention will be described hereinafter.

Figure 7:
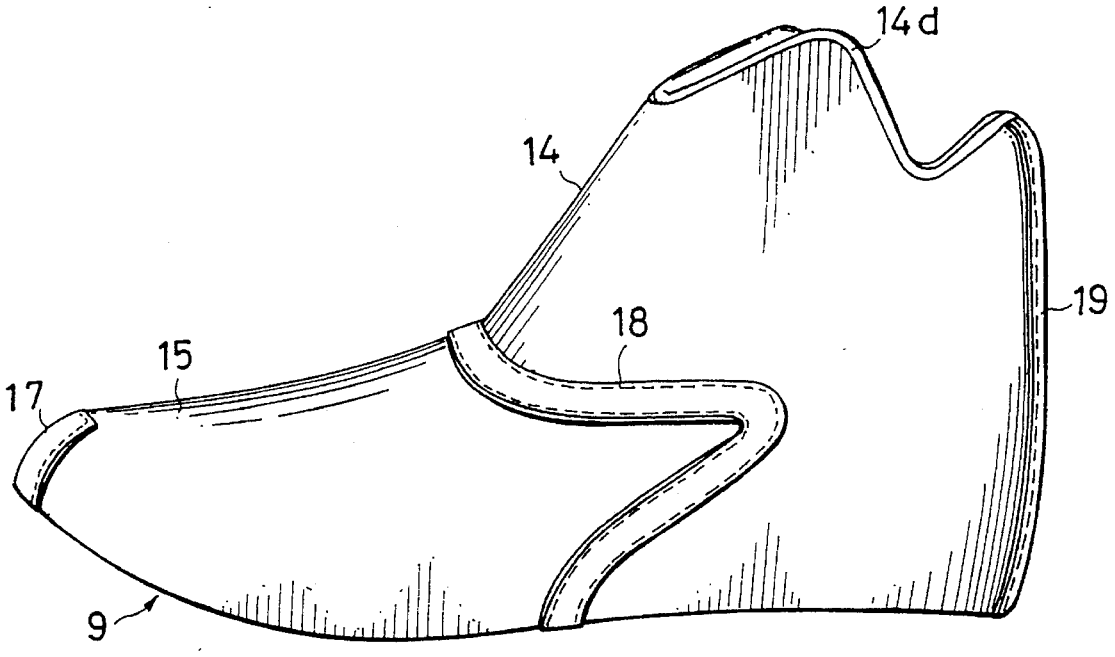
FIG. 7 is a view of variation of the sock inner according to the present invention.

In FIG. 7, the upper peripheral edge portion 14*d* is formed in zigzag, and the zigzag portion is broadened sufficiently to allow the foot to easily enter the shoe 8.

Figure 9:
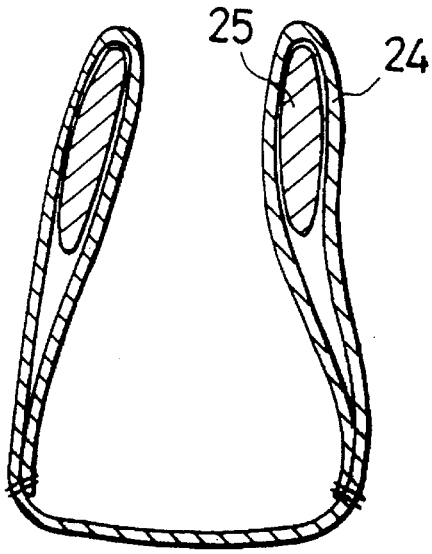
FIG. 9 is a cross-sectional view in line B—B of the sock inner of FIG. 8.

In FIGS. 8 & 9, the sock inner 23 is double-layered on each side face of the inner 24. A sponge 25 is arranged between the two layers to protect and fix the Achilles' tendon.

Figure 10:
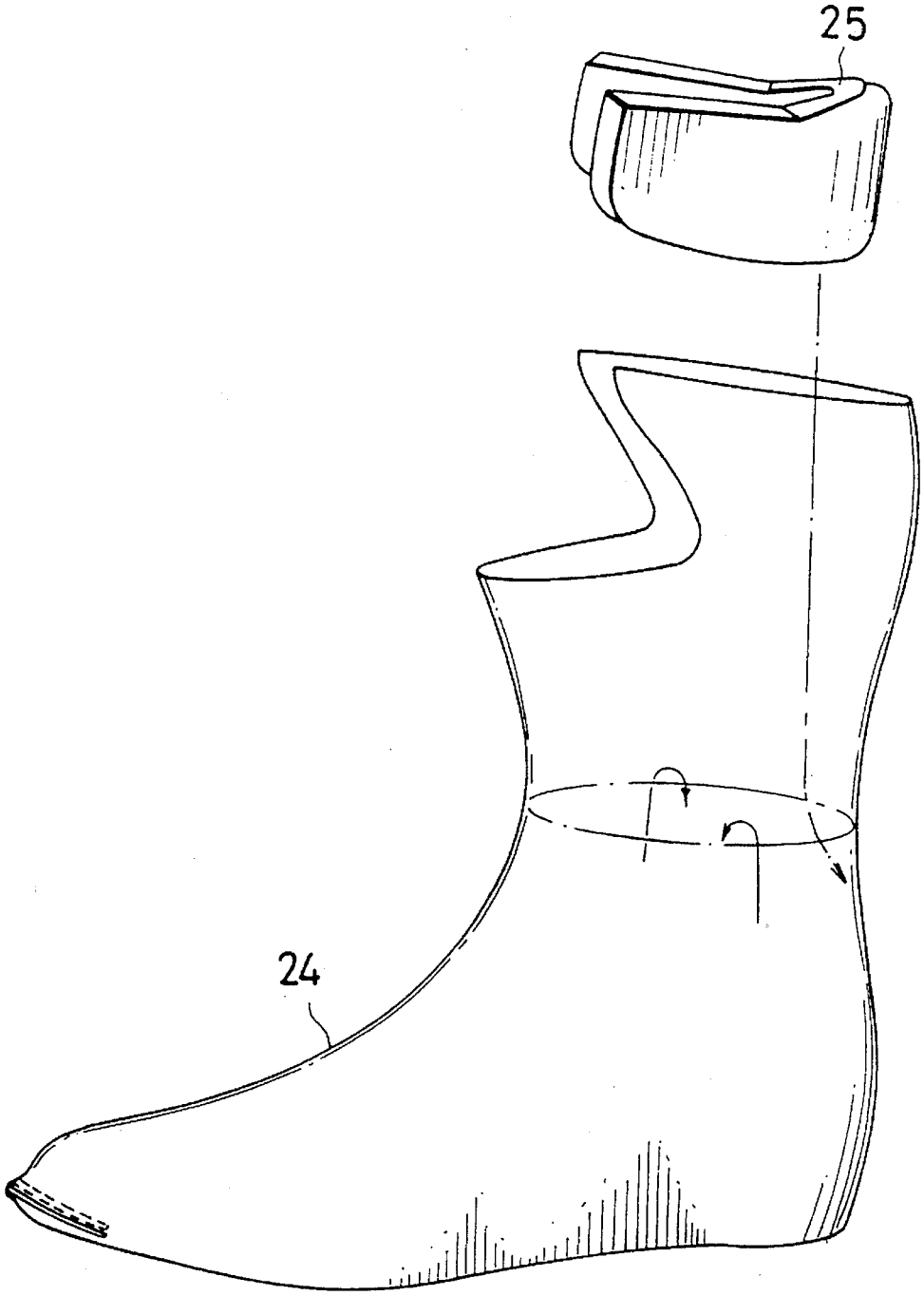
FIG. 10 is an exploded view of the shock inner of FIG. 8.

FIG. 10 shows the sock inner 3 exploded into the inner 24, and the sponge 25. An upper portion of the inner 24 is folded into the inside of the inner 24 while sandwiching the sponge 25 between the two layers.

Figure 11:
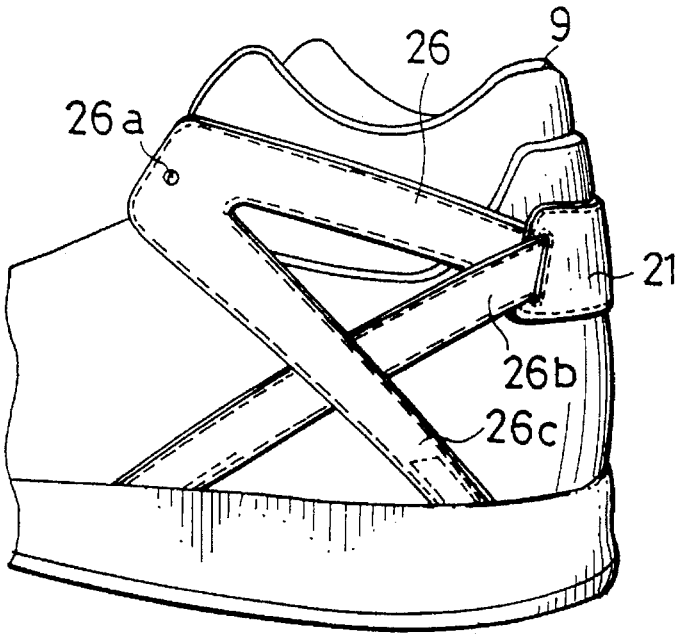
FIG. 11 is a side view of a variation of the tightening member according to the present invention.
Figure 12:
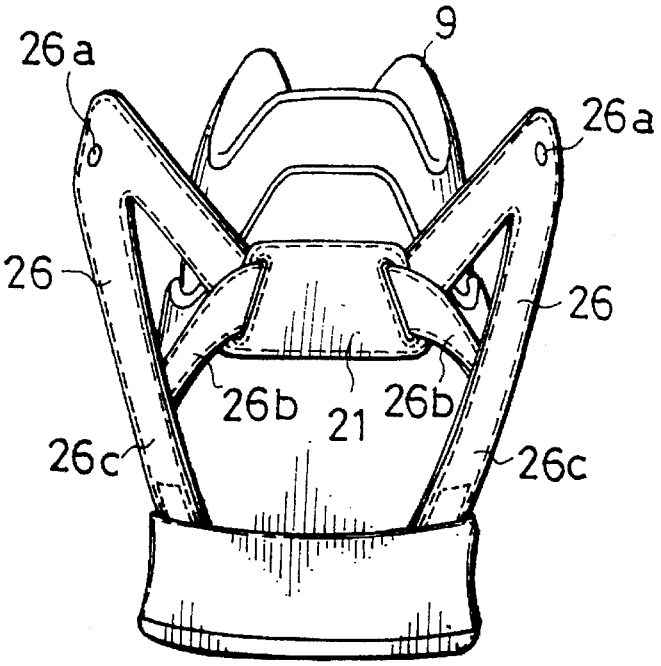
FIG. 12 is a rear view of FIG. 11.

FIG. 11 & 12 show a variation of the tightening member. One 26b of the two branches of the strap 26 is fixed through the adjuster 21 to the sole 2, and the other one 26*c* of the branches is fixed onto the sole 2 directly.

Figure 13:
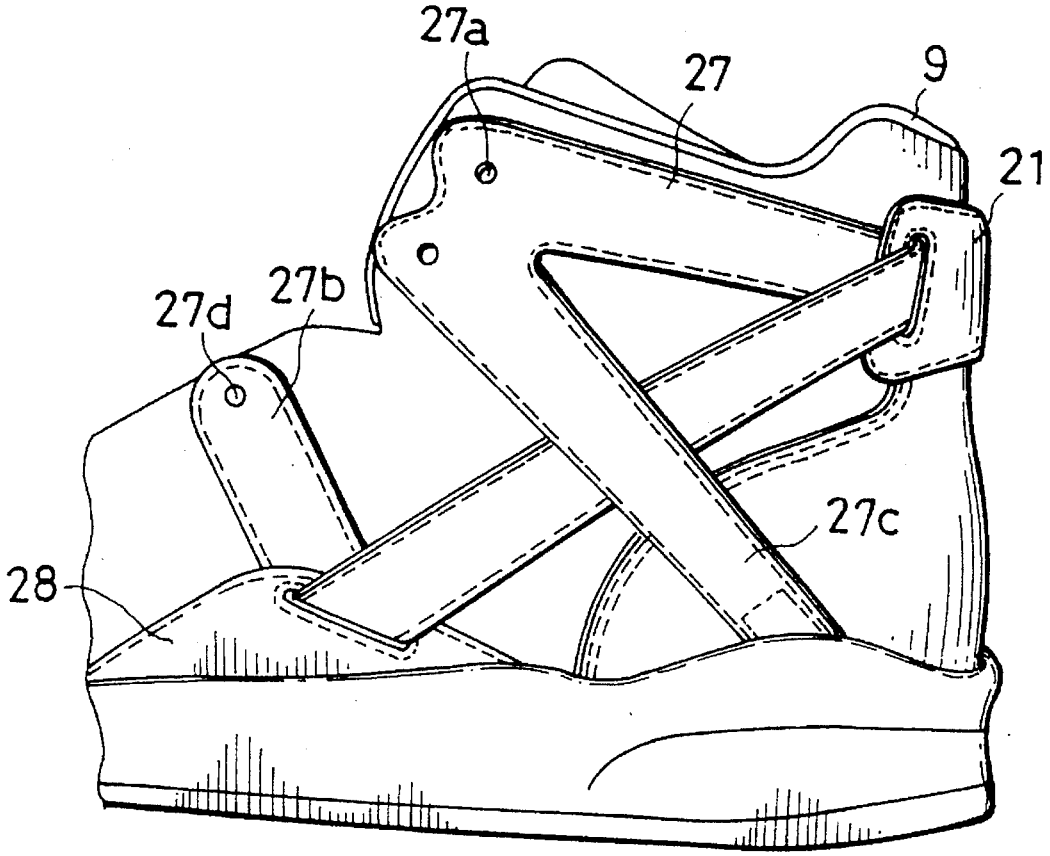
FIG. 13 is a view of another variation of the tightening member according to the present invention.

In FIG. 13, one 27*b* of the branches of the strap 27 is extended to the eyelet portion 5 through the adjuster 21 and a support portion 28 located on the sole.

Figure 14:
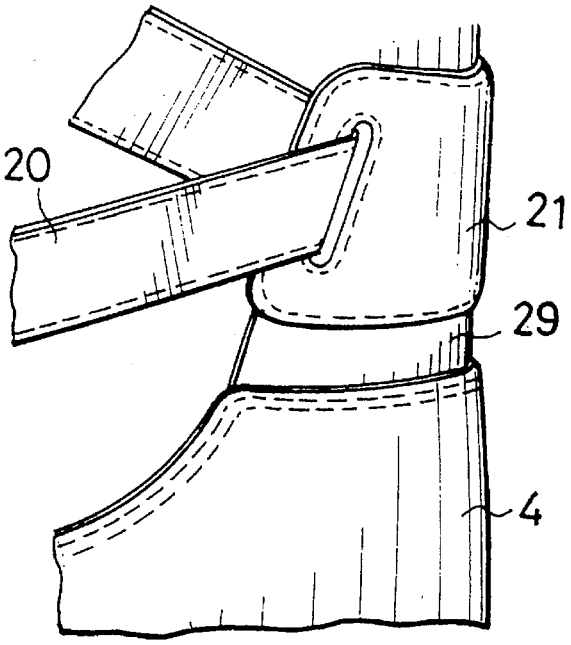
FIG. 14 is a view of a variation of an adjuster according the present invention.

In FIG. 14, a lower edge of the adjuster 21 is coupled to the heel reinforcement portion 4 through a stretch member 29.

Figure 15:
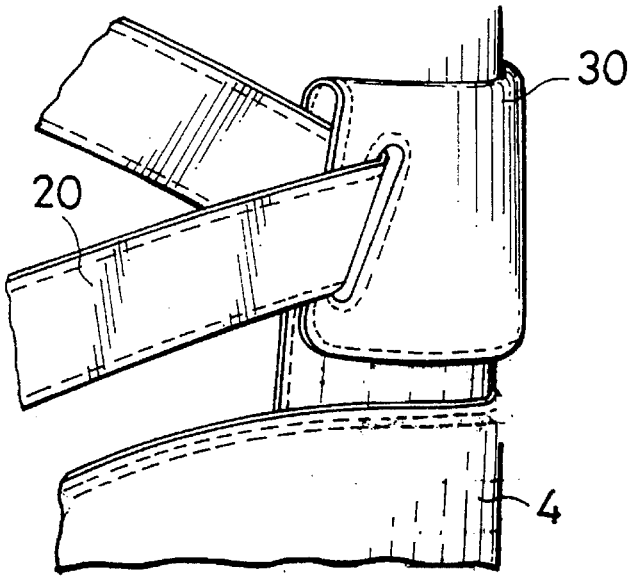
FIG. 15 is a view of another variation of the adjuster according to the present invention.

In FIG. 15, a lower edge of the adjuster 30 is fixed onto the heel reinforcement portion 4, and an upper edge of the adjustment is turned down to form the adjuster.

Figure 16:
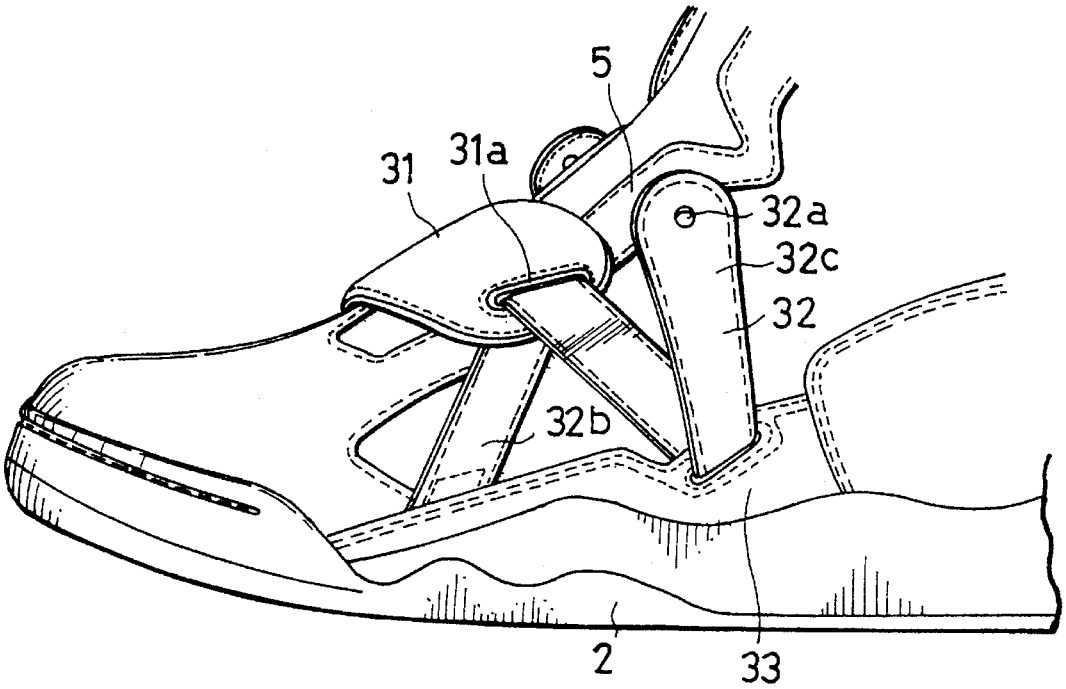
FIG. 16 is a view of still another variation of the tightening member according to the present invention.

In FIG. 16, the tightening member of the present invention is utilized for tightening the instep and the arch portion. The adjuster 31 is arranged on the eyelet portion 5. One end 32*b* of the strap 32 is fixed on the sole 2, while the other end 32*c* of the strap 32 is passed through the hole 31*a* of the adjuster 31, and is extended to the eyelet portion 5 through the support portion 33. Thus, various tightenings are possible by changing the arrangement of the adjuster and combination of the strap with the adjuster.

Figure 17:
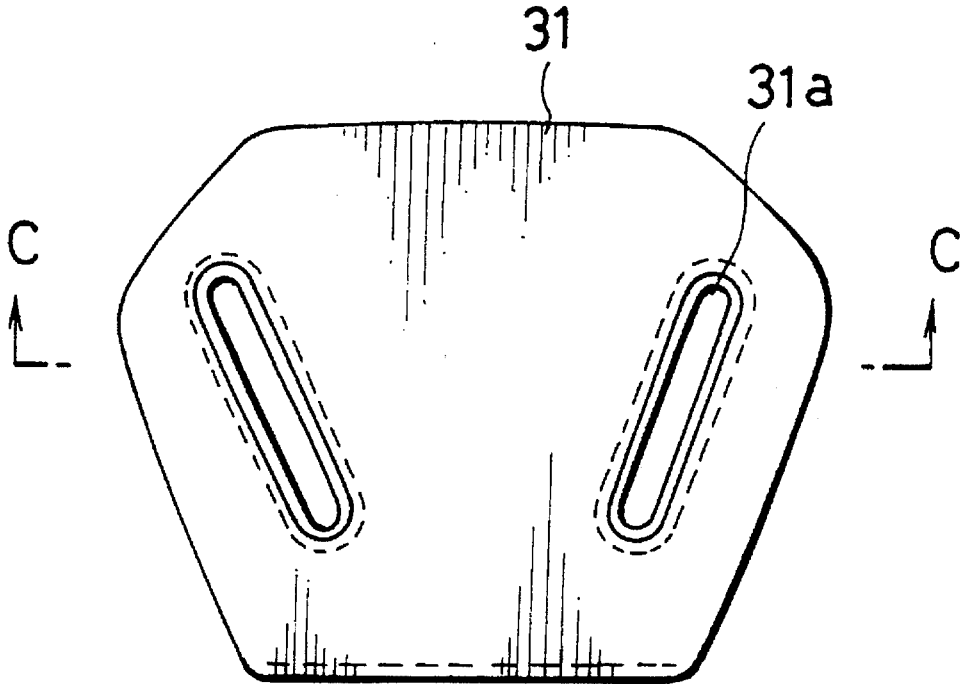
FIG. 17 is a view showing a unit of the adjuster of FIG. 16.
Figure 18:
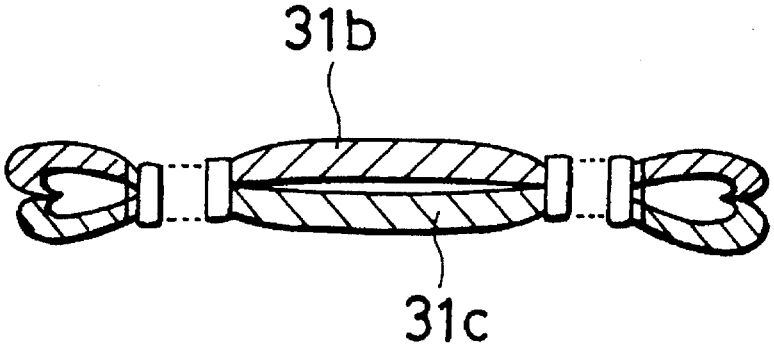
FIG. 18 is a cross-sectional view in line C—C of FIG. 16.

FIGS. 17 & 18 show a unit of the adjuster 31 used for the tightening member of FIG. 16, and a cross-sectional view of the unit of FIG. 16, respectively. The adjustment 31 has a double-layered structure consisting of an artificial leather layer 31*b* and a polyester fiber 31*c*. Thus, the well-fitting feel can be adjusted.

It will be easily understood that the present invention can be applied to not only particular shoes such as the athletic shoes, but also shoes of various types such as townshoes.

Many widely different embodiments of the present invention may be constructed without departing from the spirit and scope of the present invention. It should be understood that the present invention is not limited to the specific embodiments described in the specification, except as defined in the appended claims.

What is claimed is:

1. A shoe having a skeleton-shaped outer carapace comprising:

a sole;

a hard and skeleton-shaped outer carapace portion fixed onto said sole for holding and protecting a foot, said outer carapace portion unitedly having a toe reinforcement portion, a heel reinforcement portion, an eyelet portion, a longitudinal reinforcement portion connecting said sole with said eyelet portion, and a lateral reinforcement portion connecting said sole with said heel reinforcement portion, said longitudinal reinforcement portion completely crossing said lateral reinforcement portion in such a manner that a cross-point thereof lies at a substantial center along a side portion of said shoe between opposite ends thereof thereby to form a skeleton in association with said toe reinforcement portion, said heel reinforcement portion and said eyelet portion, said skeleton defining at least four holes around said cross-point; and a soft inner carapace portion for directly contacting a foot, said inner carapace portion being contained in said outer carapace portion and fixed on said sole in at least one portion of a lower edge thereof, and said inner carapace portion being separated from said outer carapace portion at all portions of said inner carapace above said sole in such a manner that said inner carapace portion moves independently of said outer carapace portion.

2. A shoe having a skeleton-shaped outer carapace comprising:

a sole;

a hard and skeleton-shaped outer carapace portion fixed onto said sole for holding and protecting a foot, said outer carapace portion unitedly having a toe reinforcement portion, a heel reinforcement portion, an eyelet portion, a longitudinal reinforcement portion connecting said sole with said eyelet portion, and a lateral reinforcement portion connecting said sole with said heel reinforcement portion, said longitudinal reinforcement portion completely crossing said lateral reinforcement portion in such a manner that a cross-point thereof lies at a substantial center along a side portion of said shoe between opposite ends thereof thereby to form a skeleton in association with said toe reinforcement portion, said heel reinforcement portion and said eyelet portion, said skeleton defining at least four holes around said cross-point; and a soft inner carapace portion for directly contacting a foot, said inner carapace portion being contained in said outer carapace portion and fixed on said sole in at least one portion of a lower edge thereof, and said inner carapace portion being separated from said outer carapace portion at all portions of said inner carapace above said sole in such a manner that said inner carapace portion moves independently of said outer carapace portion, said outer carapace portion having two of longitudinal reinforcement portions substantially parallel to each other and two of said lateral reinforcement portions substantially parallel to each other, which cross each other so as to form four cross-points in a center of said side portion of shoe.

3. The shoe according to claim 2, wherein said inner carapace portion is unitedly formed tri-dimensionally from a material softer than the outer carapace portion.

4. The shoe according to claim 2, wherein an upper edge of said inner carapace portion is formed in zigzag so as to be broadened for inserting the foot.

5. The shoe according to claim 2, wherein the upper portion of the inner carapace has side faces and each of the side faces is formed in a double-layer with a sponge between the double layers.

6. The shoe according to claim 2, wherein said inner carapace portion conform to the foot of a wearer and defines an opening at an upper edge thereof.

7. The shoe according to claim 2, wherein said inner carapace portion includes an upper inner for containing a portion from an arch to a heel and an ankle, a lower inner for containing a portion from a toe to the arch, and a joint tape for joining said upper inner to said lower inner.

8. The shoe according to claim 7, wherein each of said joined portions of said upper inner and said lower inner is formed in zigzag so as to retain stretchability after being joined.

9. The shoe according to claim 2, wherein said inner carapace portion is made of a flexible, air permeable and warmth-retaining material.

10. The shoe according to claim 2, wherein said inner carapace portion is made of an insulating material.

11. A shoe having a skeleton-shaped outer carapace comprising:

a sole;

a hard and skeleton-shaped outer carapace portion fixed onto said sole for holding and protecting a foot, said outer carapace portion unitedly having a toe reinforcement portion, a heel reinforcement portion, an eyelet portion, a longitudinal reinforcement portion connecting said sole with said eyelet portion, and a lateral reinforcement portion connecting said sole with said heel reinforcement portion, said longitudinal reinforcement portion completely crossing said lateral reinforcement portion in such a manner that a cross-point thereof lies at a substantial center along a side portion of said shoe between opposite ends thereof thereby to form a skeleton in association with said toe reinforcement portion, said heel reinforcement portion and said eyelet portion, said skeleton defining at least four holes around said cross-point; and a soft inner carapace portion for directly contacting a foot, said inner carapace portion being contained in said outer carapace portion and fixed on said sole in at least one portion of a lower edge thereof, and said inner carapace portion being separated from said outer carapace portion at all portions of said inner carapace above said sole in such a manner that said inner carapace portion moves independently of said outer carapace portion, said lateral reinforcement portion connecting said sole on a side of said toe reinforcement portion with said heel reinforcement portion, and said lateral reinforcement portion being intermediate a region between said eyelet portion and said sole.

12. The shoe according to claim 11, wherein said inner carapace portion is unitedly formed tri-dimensionally from a material softer than the outer carapace portion.

13. The shoe according to claim 11, wherein an upper edge of said inner carapace portion is formed in zigzag so as to be broadened for inserting the foot.

14. The shoe according to claim 11, wherein the upper portion of the inner carapace has side faces and each of the side faces is formed in a double-layer with a sponge between the double layers.

15. The shoe according to claim 11, wherein said inner carapace portion has a shape generally conformal to the foot of a wearer and has an opening at an upper edge thereof.

16. The shoe according to claim 11, wherein said inner carapace portion includes an upper inner for containing a portion from an arch to a heel and an ankle, a lower inner for containing a portion from a toe to the arch, and a joint tape for joining said upper inner to said lower inner.

17. The shoe according to claim 16, wherein each of said joined portions of said upper inner and said lower inner is formed in zigzag so as to retain stretchability after being joined.

18. The shoe according to claim 11, wherein said inner carapace portion is made of a flexible, air permeable and warmth-retaining material.

19. The shoe according to claim 11, wherein said inner carapace portion is made of an insulating material.

* * * * *